US005371527A

United States Patent [19]

Miller et al.

[11] Patent Number: 5,371,527

[45] Date of Patent: Dec. 6, 1994

[54] ORIFICELESS PRINTHEAD FOR AN INK JET PRINTER

[75] Inventors: Robert J. Miller, Stanford, Calif.; William R. Knight, Corvallis, Oreg.

[73] Assignee: Hewlett-Packard Company, Palo Alto, Calif.

[21] Appl. No.: 691,132

[22] Filed: Apr. 25, 1991

[51] Int. Cl.[5] ..... B41J 2/01

[52] U.S. Cl. ..... 347/46

[58] Field of Search ..... 346/140 R, 1.1; 400/126

[56] References Cited

U.S. PATENT DOCUMENTS

| | | | |
|---|---|---|---|
| 4,480,259 | 10/1984 | Kruger et al. | 346/140 R |
| 4,500,895 | 2/1985 | Buck et al. | 346/140 R |
| 4,502,060 | 2/1985 | Rankin et al. | 346/140 R |
| 4,580,148 | 4/1986 | Domoto et al. | 346/140 R |
| 4,584,590 | 4/1986 | Fischbeck et al. | 346/140 R |
| 4,723,129 | 2/1988 | Endo et al. | 346/1.1 |
| 4,771,295 | 9/1988 | Baker et al. | 346/1.1 |
| 4,773,971 | 9/1988 | Lam et al. | 204/11 |
| 4,791,438 | 12/1988 | Hanson et al. | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,992,808 | 2/1991 | Bartky et al. | 346/140 R |
| 5,016,028 | 5/1991 | Temple | 346/140 R |
| 5,063,396 | 11/1991 | Shiokawa et al. | 346/140 R |

FOREIGN PATENT DOCUMENTS

| | | | |
|---|---|---|---|
| 0046295 | 2/1982 | European Pat. Off. | G01D 15/16 |
| 0055139 | 2/1990 | Japan . | |

OTHER PUBLICATIONS

S. A. Elrod et al., "Focused Acoustic Beams for Nozzleless Droplet Formation", IEEE 1988 Ultrasonics Symposium Proceedings, vol. 1, 5 Oct. 1988, Chicago, Illinois, pp. 699–703.

Patent Abstract of Japan, vol. 11, No. 295, "Ink Mist Recording and Image Recorder Using Ink Mist Recording Technique", (JP 62-85948).

Patent Abstract of Japan, vol. 12, No. 81, "Liquid Jet Recording Method", (JP 62-222853).

*Primary Examiner*—Benjamin R. Fuller
*Assistant Examiner*—N. Le

[57] ABSTRACT

An orificeless thin film printhead for an ink jet pen which comprises a substrate having a plurality of vortex activators thereon, and ink dispensing means located adjacent to the substrate for providing a thin layer of ink of a controlled thickness over the surfaces of the vortex activators. A protective cover is disposed on the surface of the substrate and has one or more slots or other openings therein operative to expose the vortex activators during ink jet printhead operation. When each vortex activator is energized, the energy transferred from the surface of the activator into the liquid film creates a microjet and a shear force therein, followed by the formation of a vortex ring in the ink film. The vortex ring is in turn self-propelled at a relatively low velocity through the ink film to the free liquid surface thereby, producing stress at this surface to allow the high velocity ink at the core of the vortex ring to be efficiently transferred to an adjacent print medium with a high degree of directionality, thereby enhancing resolution and print quality on the printed media. In accordance with the present invention, vortex activators include, but without limitation, heater resistors, piston drivers, and piezoelectric cavities.

11 Claims, 6 Drawing Sheets

T = 0

T = 110 us

ORIFICELESS PRINTHEAD FOR AN INK JET PRINTER

TECHNICAL FIELD

This invention relates generally to printheads for ink jet printers and more particularly to a thermal ink jet (TIJ) printhead having no ink jet orifice plate thereon.

BACKGROUND ART

For many years, ink jet technologies which have been developed to produce printheads for ink jet printers and the like have included sub-categories or sub-technologies directed specifically to forming the output ink ejection orifice plate or nozzle plate for controlling the ink drop patterns and ink trajectories onto an adjacent print medium. As is well known to those skilled in the art, these orifice plate technologies include those for making silicon orifice plates, glass orifice plates, plastic orifice plates, and metal orifice plates of many different kinds of materials in each of the latter four types of orifice plate categories. In addition, these metal (e.g. nickel) orifice plate technologies include electroforming and electroplating processes including the fabrication of mandrels for making small geometry precision architecture orifice plates for attachment to thin film printhead substrates.

An example of one highly successful type of thermal ink jet printhead which uses a nickel orifice plate is the St. Helens printhead which has been an integral part of the ThinkJet TM disposable thermal ink jet pen sold in large quantities since 1985 by the Hewlett Packard Company of Palo Alto, California. This printhead uses a well known materials set which includes a silicon or quartz substrate upon which thin film layers of silicon dioxide, tantalum aluminum, and aluminum trace material are formed and used to define a pattern of tantalum aluminum heater resistors and electrical interconnects thereto. This thin film printhead structure further includes surface protective layers of silicon nitride and silicon carbide for covering the exposed surfaces of the tantalum aluminum heater resistors and the aluminum conductive trace patterns connected thereto. A polymer barrier is then photolithographically processed on the surface of the silicon nitride/silicon carbide composite layer to define the ink feed channels and ink firing chambers for the heater resistors, and then the nickel orifice plate is precisely aligned and attached to the polymer barrier layer. Orifice openings or "orifii" in the nickel orifice plate are thus carefully aligned with respect to the firing chambers and heater resistors within the thin film printhead structure. For a more detailed description of the above thin film printhead fabrication processes, reference may be made to the *Hewlett Packard Journal,* Volume 38, No. 5, May 1985. For a more detailed discussion of nickel orifice plate manufacturing per se, reference may be made to U.S. Pat. No. 4,773,971 issued to Si Ty Lam et al, assigned to the present assignee and incorporated herein by reference.

As an alternative to the above printhead fabrication techniques which require not only refined processes for forming the orifice plates, but sophisticated and expensive alignment techniques for attaching the orifice plates to the thin film printhead structures, "orificeless" printheads have been proposed to replace the above described thin film ink jet printheads which have traditionally used orifice plates of various sizes, shapes, and materials. An example of such an orificeless printhead is disclosed in U.S. Pat. No. 4,580,148 assigned to Xerox, and hereinafter referred to as the Xerox patent. The devices disclosed in the Xerox patent operate to develop a thin film of ink on a predefined surface area of the printhead which includes patterns of heater resistors thereon. The thin film of ink is held in place by surface tension, and the heater resistors are fired to eject droplets of ink from this thin film of ink onto an adjacent print media.

However, the disclosed Xerox printhead is operative with several disadvantages, among which include the creation of a vapor bubble in the thin aqueous-based ink film which is characterized by non-uniform nucleation that produces a rough surface area on the bubble and thus poor directionality of the ejected droplets. Thus, the printhead described in the Xerox patent also requires an additional level of design complexity to correct this problem, such as the inclusion of an electrostatic force to provide guidance and directional stability to the ejected droplets. In addition, the printhead device disclosed in the Xerox patent has been designed to use the conservation of momentum of collapsing vapor bubbles exclusively. Therefore, it is not obvious from the teachings of this Xerox patent how to design an ink jet printer that does not include a vapor bubble or that is not thermally driven.

DISCLOSURE OF INVENTION

The general purpose and principal object of the present invention to provide a novel approach to and technology for making new and improved orificeless ink jet printheads which are operative to overcome most, if not all, of the above disadvantages associated with the Xerox type of thermal ink jet printheads described above.

Another object of this invention is to provide a new and improved orificeless ink jet printhead of the type described which has improved bubble nucleation characteristics and improved ink drop trajectory and directionality characteristics.

Another object of this invention is to provide a new and improved orificeless ink jet printhead of the type described which is uniquely adapted to operate with nonaqueous based, low surface tension inks which are more compatible with solid phase ink systems.

Another object of this invention is to provide a new and improved orificeless thermal ink jet printhead of the type described which exhibits an improved control over ink bubble size-to-ink film thickness ratio, thereby allowing for the use of a wider range of jettable inks.

Another object of this invention is to provide a new and improved orificeless ink jet printhead of the type described which operates to form projectiles of ink, not jets of ink, thereby introducing a new printing technology to the field of ink jet printing.

Another object of this invention is to provide an orificeless technology that is not limited to a thermal ink jet printer design.

Another object of this invention is to provide a new and improved orificeless ink jet printhead of the type described which is especially well suited for use in a line printer as compared to conventional ink jet printer designs using orifice plate technology.

To accomplish the above purpose and objects in accordance with the present invention, there has been discovered and developed a novel ink jet printhead which includes, among other things:

a. a flexible printhead substrate made of a suitable material such as copper or plastic and having good heat dissipation characteristics and including a plurality of heater resistors acting as vortex activators disposed in a chosen array adjacent to a major surface of the substrate. Vortex ring activation as described herein may be produced by either heater resistors or piston drivers or other equivalent ink driving mechanisms such as piezoelectric devices, so that the term "vortex activators" as used here should be broadly interpreted. The vortex ring is a whirling mass of ink which forms a region of reduced pressure at its center and is propagated to the ink surface where it produces a disruption as described below;

b. a protective cover having one or more slots or openings therein is provided atop the substrate and exposes the heater resistors for ink vortex activation and ink drop propulsion operation;

c. movable ink dispensing means are positioned at the surface of the printhead substrate and adjacent to the heater resistors for continuously wiping across the heater resistors and providing a thin film of ink of a controlled thickness over the surfaces of the heater resistors. In this manner, the firing of the heater resistors produces a bubble collapse at the surface of the heater resistors followed by the formation of a vortex ring above the heater resistors which is self-propelled and moves perpendicular to the plane of the heater resistors toward the surface of the liquid ink film. When the vortex ring reaches the surface of the ink film, it produces a local convex surface deformation, and this action allows the high velocity microjet at the core of the vortex to be efficiently transferred from the ink film to an adjacent print medium.

In one embodiment of this invention, the movable ink dispensing means includes one or more resistive wire applicators or blades which are swept across the surfaces of the vortex activators at a controlled angle and rate.

In a second embodiment of this invention, the movable ink dispensing means includes a movable oscillating cord which is an ink flow communication with a source of ink and is operative to be continuously moved adjacent to the surface of the substrate containing the vortex activators. This action operates to continuously replenish the thin film of liquid ink on the substrate during the operation of the ink jet printhead.

In a third embodiment of the invention, the heater resistors may be replaced with a piston type driver such as the driven wires of an impact printer which are then used to create a vortex ring in a thin film of liquid ink.

The above brief summary of this invention, together with its attendant advantages and novel features, will become more readily apparent from the following description of the accompanying drawings.

DETAILED DESCRIPTION OF THE PREFERRED EMBODIMENTS

Figure 1:
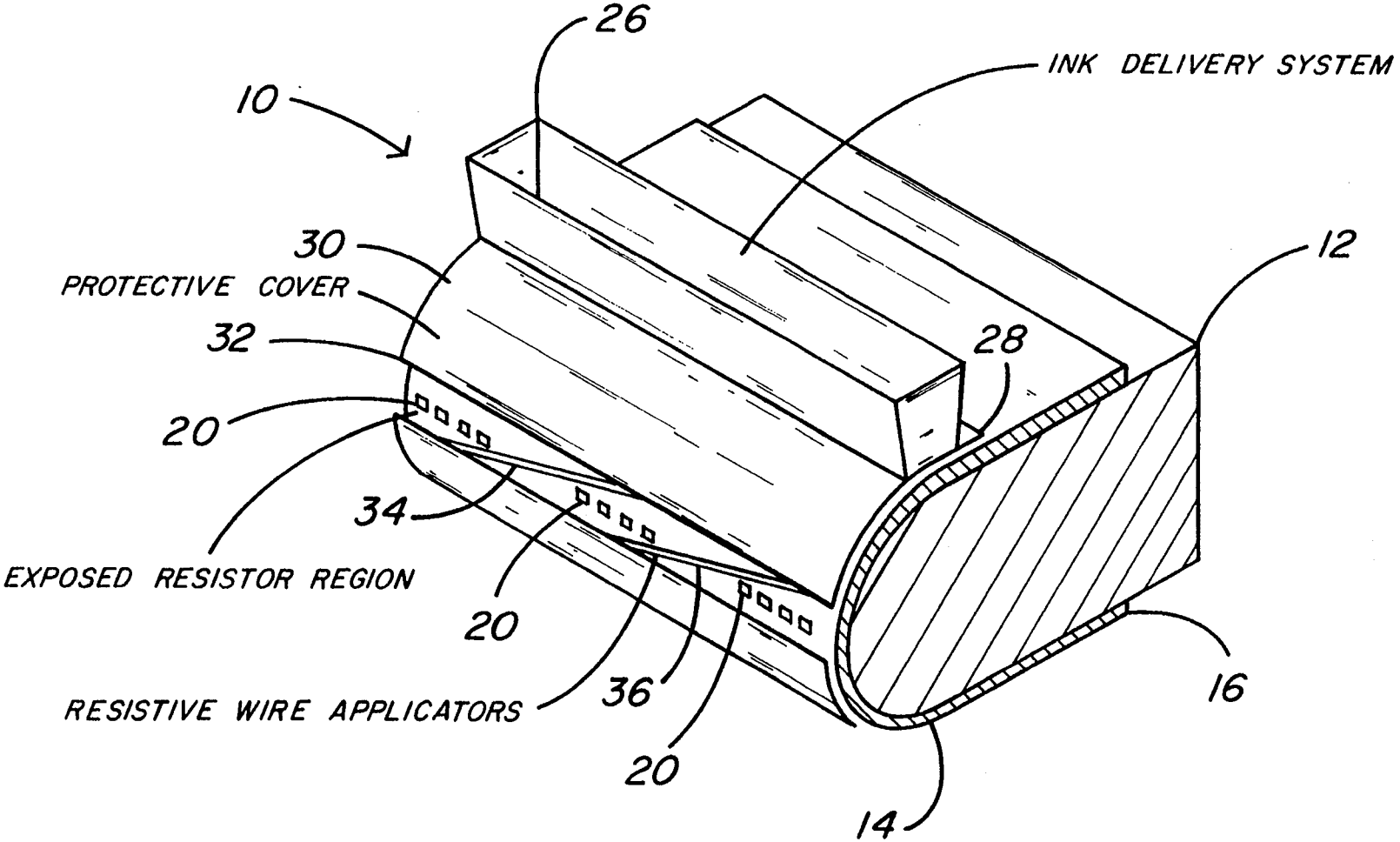
FIG. 1 ian isometric view of an orificeless thermal ink jet printhead fabricated in accordance with a first embodiment of this invention.

Referring now to FIG. 1, the orificeless thermal ink jet printhead shown therein is designated generally as 10, and it includes a heat sink member 12 having a rounded end surface 14 at one end thereof for receiving a flexible substrate member 16 in the wrap-around configuration shown. The heat sink 12 may be constructed with or without cooling fins (not shown) which may be attached to the substrate 16. Preferably, the substrate member 16 is a flexible strip of copper which contains a thin layer of a suitable dielectric material (not shown) thereon for receiving a plurality of heater resistors 20 on the contoured surface thereof. The specific electrical interconnections and surface passivation layers for the heater resistors 20 have been omitted for sake of simplicity. These dielectric layers and associated electrical connections may be made using well known dielectric layer forming processes and heater resistor interconnect techniques such as those disclosed, for example, in the above identified *Hewlett Packard Journal* article which is incorporated herein by reference. These processes are also disclosed in the *Hewlett Packard Journal,* Volume 39, No. 4, August 1988, also incorporated herein by reference. Alternatively, the metal substrate member 16 may be electroformed of nickel using the electroforming processes described in U.S. Pat. No. 4,773,971 issued to Si Ty Lam et al and in copending U.S. patent application Ser. No. (Case No. 188117) of Si Ty Lam et al, both assigned to the present assignee and incorporated herein by reference.

An ink delivery system 26 may advantageously be positioned as shown to feed ink into an elongated opening 28 in the protective cover 30 and onto an underlying ink receiving section of the flexible substrate member 16. The thin protective cover 30 having an elongated slot 32 therein is positioned on the rounded or contoured surface of the flexible copper substrate 16 from one side of the substrate adjacent to ink delivery system 26 to the opposite side of the rounded substrate end 14. Using appropriate spacers, the protective cover 30 which may serve as a doctor blade and may be separated a small distance of approximately one-hundred (100) micrometers above the flexible substrate member 16 in order to allow a thin film of ink to flow from the ink delivery system 26 and beneath the protective cover 30 and over the surfaces of the heater resistors 20 serving as vortex activators. Alternatively, the protective cover 30 may be heated and placed in intimate contact with the copper substrate 16 if the ink flow path from the ink delivery system 26 to the heater resistors is not directly beneath the heated protective cover 30.

The control over the thickness and continuous distribution of this thin film of ink to the heater resistors 20 is accomplished by the simultaneous back and forth movement of a pair of resistive wire applicators or blades 34 and 36. These heatable applicators 34 and 36 operate to move in parallel across the surfaces of the heater resistors 20 and to continuously bring in fresh liquid ink from the ink delivery system 26 and simultaneously maintain the thickness of this liquid film at the surfaces of the resistors 20 at a uniform and controlled thickness typically in the range of about 50 to 100 micrometers. In addition, solid inks may be used as well as liquid inks and heated to a liquid state by applying a controlled current to the wire applicators 34 and 36.

As described in more detail below with reference to FIGS. 3A through 3H, the heater resistors 20 will be fired by the appropriate electrical pulsing thereof to initially create a bubble in the liquid ink film on the surfaces of these resistors. When this bubble collapses, a vortex ring is created at the location of the bubble collapse and is self-propelled to the surface of the liquid film having no orifice plate thereon where it generates vortices of opposite sign. As the propagating vortex ring gets closer to the surface of the liquid film, the vortices created in the liquid film disrupt the liquid film surface. Once the liquid film surface is disrupted, the high velocity fluid at the core of the vortex ring produces a liquid jet with an ink droplet break-off similar to that shown in FIG. 3H below. In addition, the ink drop trajectory, directionality control and thus the enhanced resolution and print quality on the resulting printed media is also enhanced.

Figure 2:
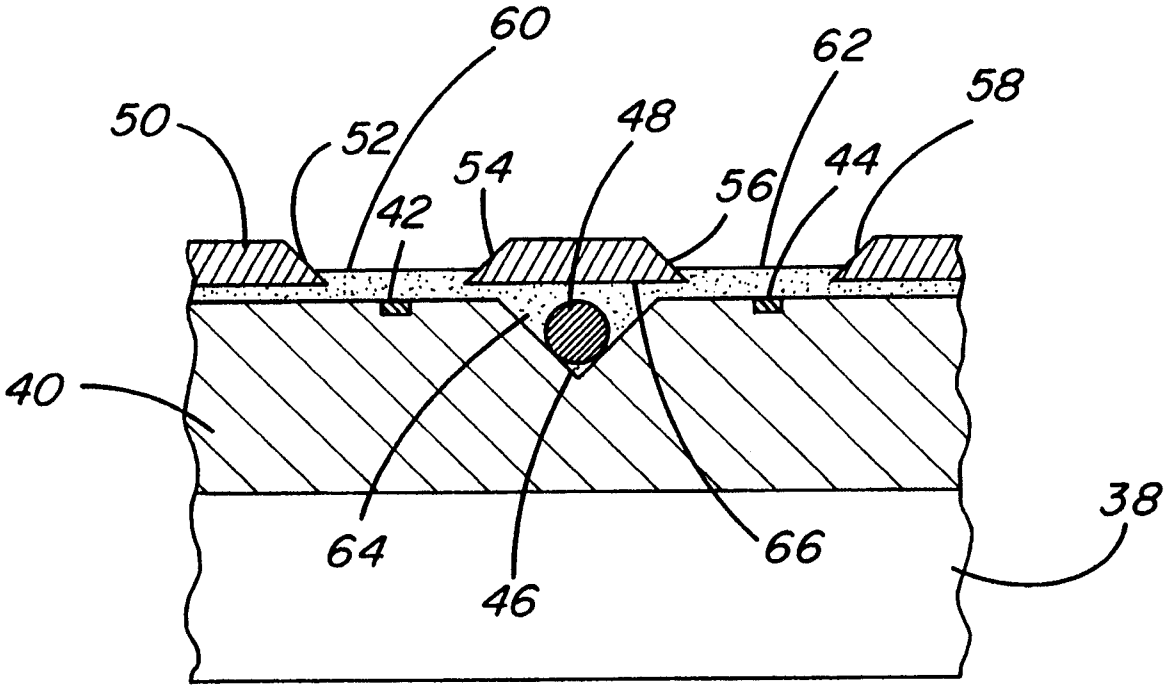
FIG. 2 is an abbreviated cross section view of a thermal ink jet printhead which may be constructed in accordance with a second embodiment of this invention.

Referring now to FIG. 2, this schematic cross section view illustrates a second or alternative embodiment of the present invention having a dielectric film 40 deposited on a copper substrate 38 and containing a plurality of heater resistor rows 42 and 44 serving as vortex activators. The dielectric layer 40 includes a V-shaped groove 46 into which an oscillating cord 48 is positioned and operates to be continuously advanced at a controlled rate. A protective cover 50 is mounted as shown on the top of the dielectric layer 40, and it is configured with the angled surfaces 52, 54, 56, and 58 so as to define a pair of elongated slots 60 and 62 spaced from the rows of heater resistors 42 and 44. The width of these elongated slots 60 and 62 will typically be in the range of 1-5 millimeters, and the width of the slot-centered heater resistors 42 and 44 will typically be between 40–100 micrometers.

The angled surfaces 52, 54, 56, and 58 have been beveled at a critical angle of about 35 degrees which operates to control the thickness of the liquid ink 64 which covers the oscillating cord 48, fills in the V-shaped groove 46 and extends to a thickness of about 25 to 100 micrometers above the substrate surface. This thickness is equal to the distance between the bottom surface of the protective cover center strip 66 and the top surfaces of the heater resistor rows 42 and 44 positioned as shown at the top surface of the dielectric layer 40.

The oscillating cord 48 may be of a suitable wettable material such as nichrome wire and is operative to oscillate at a predetermined rate and to continuously move between an ink reservoir (not shown) and through the V-shaped groove 46 in the dielectric film 40 to continuously supply a source of liquid ink 64 to the ink volume outlined in the cross section view of FIG. 2. In other respects, the thermal ink jet printhead device shown in FIG. 2 operates in a manner identical to that described with reference to FIG. 1 above to create and propel vortices of ink through the ink film 64 and onto an adjacent print medium shortly following the collapse of a vapor bubble produced in the liquid film 64 upon the firing of rows or patterns of heater resistors 42 and 44.

Figure 3A:
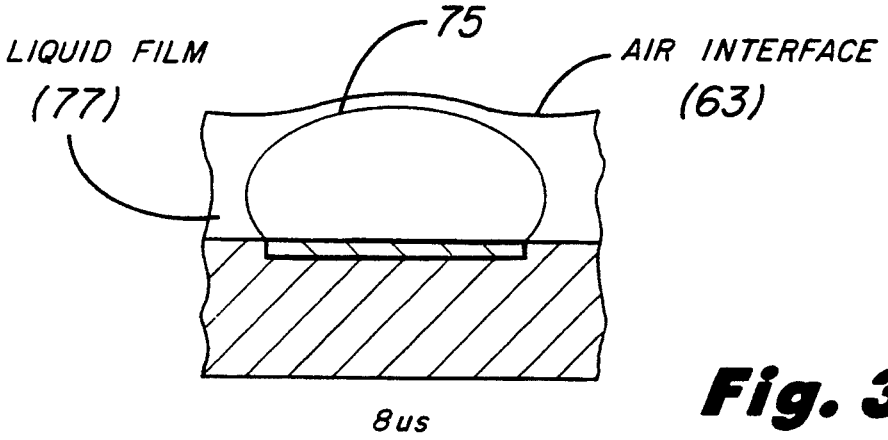
FIGS. 3A through 3H are a series of schematic cross section views showing the formation of a vortex ring in a thin film of ink and the ink droplet break-off profile produced thereby.

Referring now to FIGS. 3A through 3H, there is shown in these eight figures the formation of the vortex ring of liquid ink immediately upon the collapse of a vapor bubble 75 in FIG. 3A within the liquid film of ink at eight different times (in microseconds) after an ink jet heater resistor of a Hewlett-Packard ThinkJet TM printhead has been activated by applying a 5 microseconds (μs) pulse set at a threshold current of about 0.3 to 0.5 amps. The repetition rate is about 100 to 1000 Hz. These eight figures are based upon data extracted from three separate optical experiments observed under a microscope with flash-lamp illumination.

The bubble collapse sequence represented by the views in FIGS. 3A through 3D depict the events that lead to the formation of the vortex ring 61 (FIG. 3D) in a pond of isopropanol in which there was no air interface. The air interface 63 was added to the FIGS. 3A through 3D in order to illustrate this sequence of events in a free film. The velocity vectors 65 in these figures are representative of the flow pattern that develops when a dispersion of $BaSo_4$ in isopropanol is used in a direct-insertion technique. The jet formation sequence represented by FIGS. 3E through 3H depict the events that lead to the formation of a jet. 85 (FIG. 3H) from a liquid film of isopropanol that is seventy (70) micrometers deep. The vortex marker 69 is observable in both the pond and film based configurations and is most likely the residual air bubbles or voids 71 (FIG. 3C) that become entrapped in the vortex ring immediately following bubble collapse.

In FIG. 3A, at eight microseconds after the heater resistor has been activated, a vapor bubble is developed in the liquid film and in the generally oval shaped cross section shown. It is important to note here that the bubble nucleation that is occurring in FIG. 3A is a form of nearly uniform nucleation which will take place in a non-aqueous based, low or high viscosity ink and will in turn tend to minimize ink spraying and maximize the directionality of the developing jet described below in FIGS. 3B through 3H. This nearly uniform nucleation is in significant contrast to the rough multiple bubble nucleation that occurs at the surfaces of the heater resistors in the printhead disclosed in the above Xerox U.S. Pat. No. 4,580,148 representing the known relevant prior art.

Figure 3B:
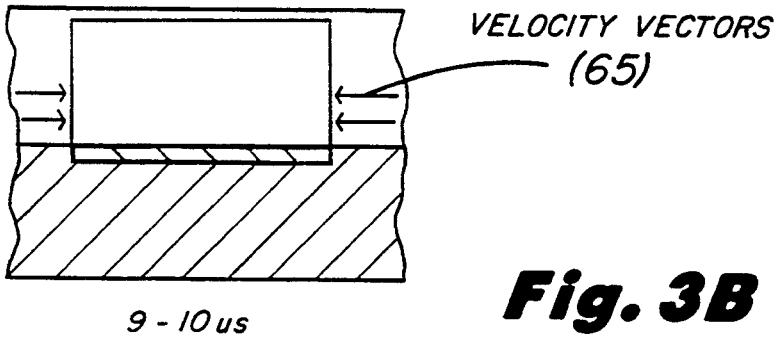
Figure 3C:
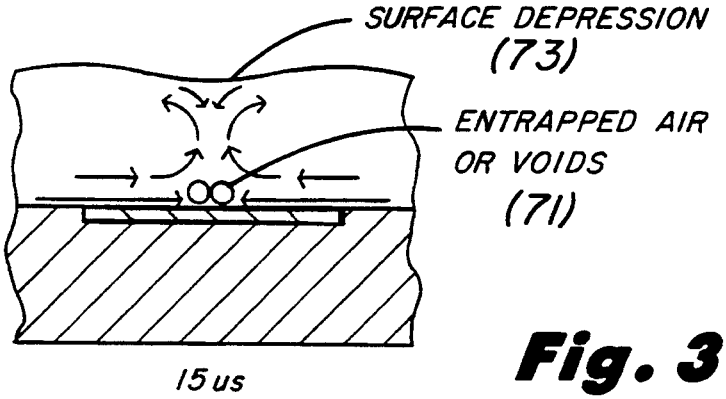

In FIG. 3B, the vapor bubble 75 begins a sidle collapse at 9–10 microseconds as indicated by the velocity vectors 65 in this figure. This collapse proceeds to completion as indicated in FIG. 3C, creating the high-velocity fluid microjet 67 in FIG. 3D and the entrapped air or voids 71 that serve as a vortex marker for the vortex ring 61 in FIG. 3D. At this point (FIG. 3C) the vortex ring 61 is not visually observed but is probably formed as a result of the microjet that shears perpendicularly to the liquid film and over the surface of the heater resistor. The liquid flow pattern is indicated by the velocity vectors 65 shown, and for yet some unexplained reason a slight surface depression 73 is observed and is possibly due to a secondary vortex of opposite sign that is induced by the formation of the primary vortex ring near the resistor surface.

Figure 3D:
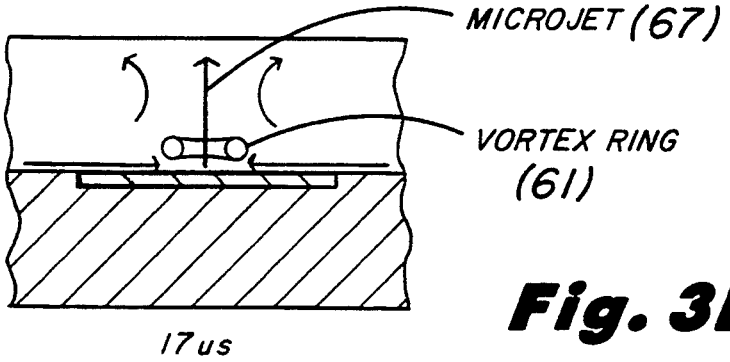
Figure 3E:
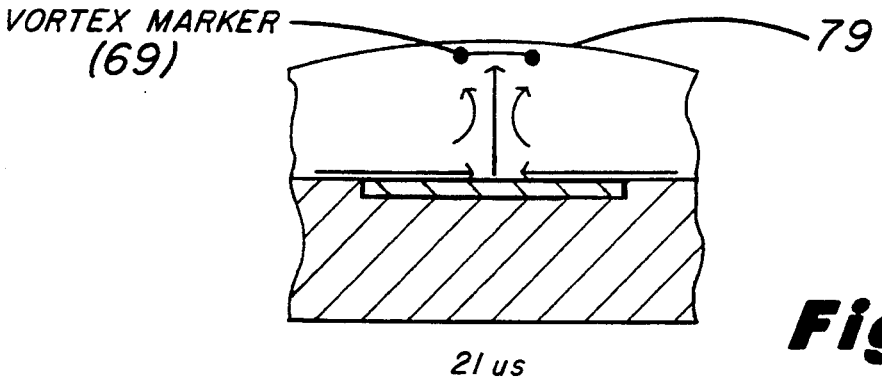

In FIG. 3D, the vortex ring 61 is readily observed at about 17 microseconds after resistor activation by the distinct refractive patterns formed in a pond or by the path lines traced in the liquid when a direct-insertion technique is used. From pond experiments, the velocity of the high-energy vortex ring through isopropanol is about 4–6 meters per second (m/s) and the high-velocity core of the vortex has a velocity measured in 10's of m/s. The vortex marker 69 in FIG. 3E is also readily observed in a pond experiment or a free film experiment with proper optical configurations. For observing the vortex marker in a free film, a flash source is reflected off the resistor surface rather than the film surface.

In FIG. 3E, the vortex ring (indicated by the vortex marker 69) applies a stress to the film surface causing a convex surface deformation 79. Thus, the travel time of the vortex ring to reach the surface of the 70 μm film is about 6 μs which implies that the vortex ring is created about 30 to 50 μm above the resistor surface.

Figure 3F:
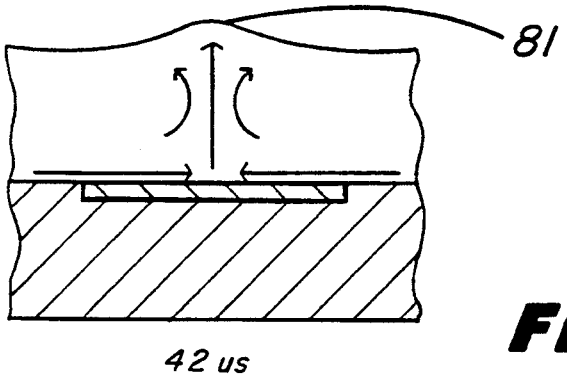
Figure 3G:
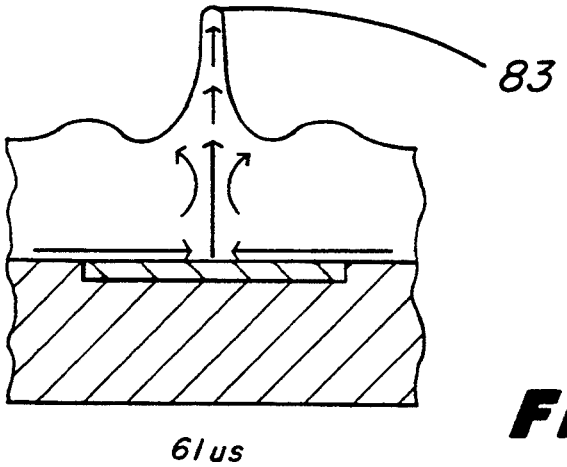

Then, in FIG. 3F, the liquid ink at the core of the vortex is propelled in the trajectory 81 shown, and this trajectory continues to subsequently produce the projectile 83 as shown in FIG. 3G with a high degree of energy transfer efficiency and directionality perpendicular to the surface of the liquid film. This will occur at approximately 61 microseconds in FIG. 3G after heater resistor firing. If the film thickness to bubble height ratio exceeds 1.3, then the projectile is stable and no droplet is formed. Finally, in FIG. 3H, the ink projectile begins to neck down in the general droplet profile 85 as shown in this figure to form ink droplets at approximately 110 microseconds after heater resistor firing.

Figure 4A:
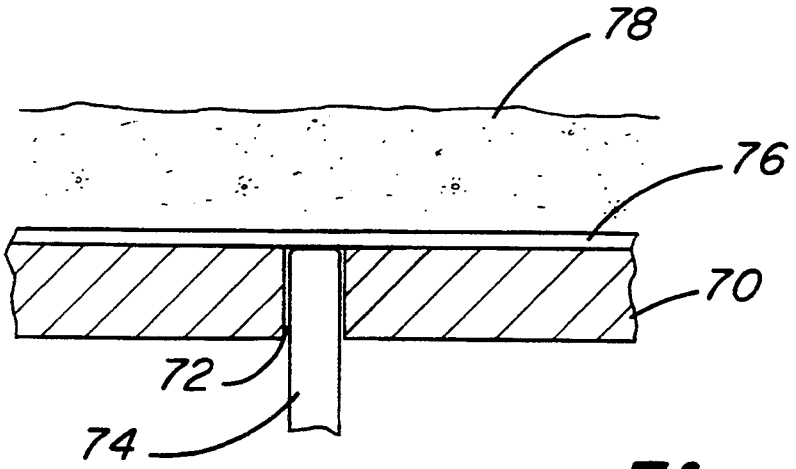
FIGS. 4A through 4C are schematic abbreviated cross section views which illustrate yet another third embodiment of this invention in which impact printing techniques are employed to form the vortex ring in the thin film of ink.
Figure 4B:
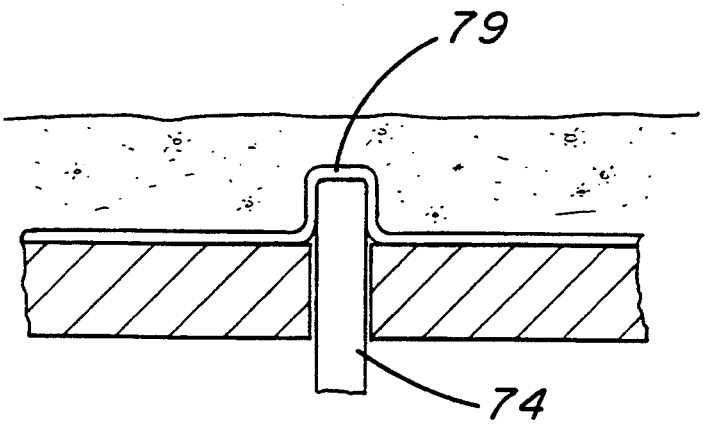
Figure 4C:
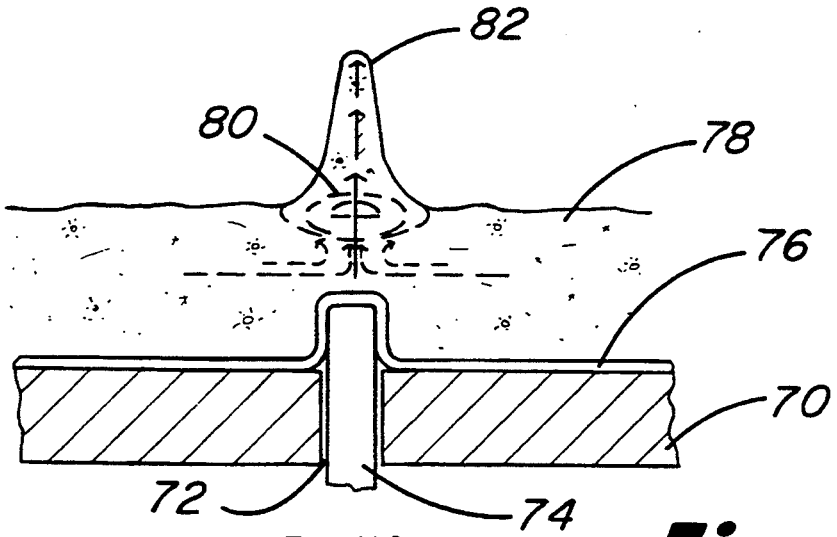

Referring now to FIGS. 4A through 4C, there is shown an impact piston driver printhead embodiment of the invention wherein a suitable printhead substrate member 70 is provided with a central opening 72 therein for receiving a print wire 74 of about 5–25 micrometers in diameter and which is driven by conventional impact printing mechanisms or a piezoelectric (PZT) crystal. The substrate 70 may be made of a suitable plastic, metal or ceramic material and will preferably have a thin membrane 76 thereon of a material such as silicone rubber. This membrane may be utilized in accordance with the teachings in U.S. Pat. No. 4,480,259 issued to Kruger et al, assigned to the present assignee and incorporated herein by reference. The thin membrane 76 supports a thin film of ink 78 which will typically be on the order of 100 to 200 micrometers in thickness.

When the piston 74 serving as the vortex activator extends as indicated in FIG. 4B at time t=0, the thin membrane 76 will be flexed upwardly into position 79 shown in this figure. This motion produces the velocity vectors shown in FIG. 4C which are created to form the vortex ring 80 indicated in this figure. Here the vortex core of ink 82 is being propelled from the center of the vortex ring 80 at one hundred and ten (110) microseconds after initial piston movement and onto an adjacent print media. The absence of a vapor bubble in this embodiment is unique to this invention.

Figure 5A:
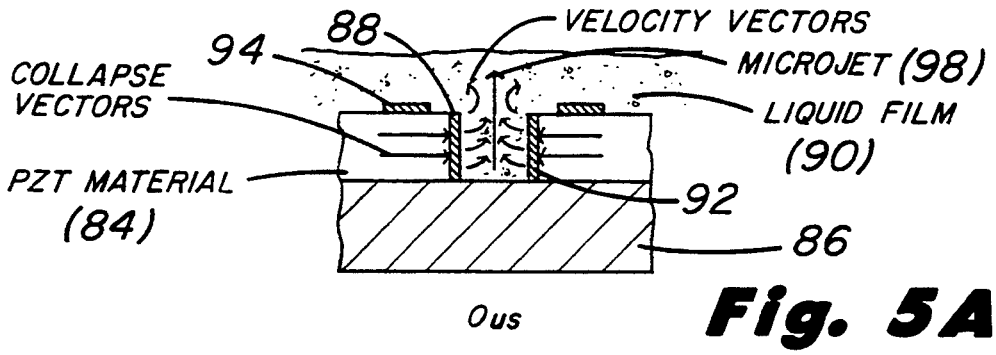
FIGS. 5A through 5E are abbreviated schematic cross section views of yet another embodiment of this invention which employs either discrete piezoelectric transducers or an array of piezoelectric transducers, respectively, having preconfigured cavities therein which are operatively driven to collapse and produce a vortex ring and associated ink droplet break-off profile of the type shown in FIGS. 3D through 3H.

Referring now in sequence to FIGS. 5A through 5E, there is shown in FIG. 5A a piezoelectric (PZT) film member 84 mounted on a suitable substrate 86 such as glass, silicon, ceramic or the like and having at least one cavity 88 constructed therein. The PZT film 84 is positioned to receive a liquid film 90 of a selected ink, and the PZT film 84 is preferably of a chosen polymeric or polycrystalline material. One suitable polymeric PZT material is sold under the tradename KYNAR TM available from the Pennwalt Corporation. One suitable polycrystalline material is sold by the Vernitron Corporation under the designation PZT-5H, which is a lead zirconium titanate material. This material can be radially polarized and provided with a suitable set of pulse drive electrodes using available electrode-less deposition techniques. In the off state shown in FIG. 5A, the cavities 88 will have a diameter of at least 20 micrometers and a depth of at least 10 micrometers. The preferred depth of the cavity 88 is between 25 and 100 micrometers and the preferred diameter of the cavity 88 is between 20 and 150 micrometers.

One useful method for providing electrical interconnects to the PZT cavity 88 is to deposit, such as by electro-less deposition, a thin inner electrode 92 on the interior walls of the cavity 88 and to form an outer electrode 94 in the form of an annular shaped ring coaxially with the inner electrode 92 using conventional masking and metal deposition processes. With this approach, high frequency and high voltage electric fields can be generated between these inner and outer electrodes which will in turn generate the necessary stresses in the PZT film 84 useful to provide the constriction of the cavity 88 shown in FIG. 5B. The arrows in FIG. 5A are representative of the velocity vectors which are produced within the liquid within the cavity 88 when the interior walls thereof begin to collapse under the influence of either high voltage pulses or a high frequency burst of energy applied to the electrodes 92 and 94.

Figure 5B:
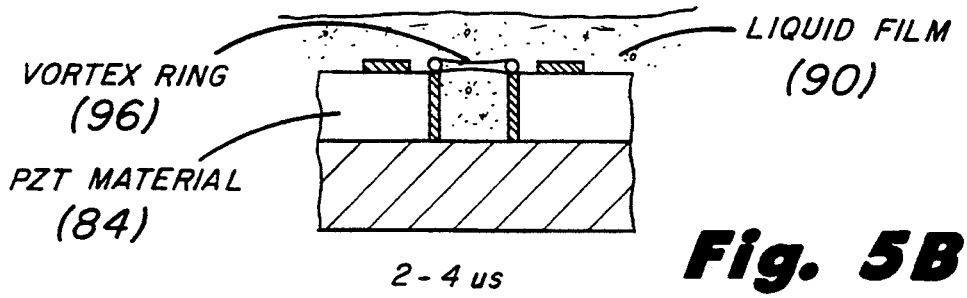

Instead of using the inner electrode 92 as shown, a lower PZT film surface electrode (not shown) may be formed on the lower surface of the PZT film 84 and pulsed together with the electrode on the upper surface of the PZT film 84 to produce lateral shear forces within the PZT film 84 which in turn will have the effect of producing a lateral constriction within the cavity 88 as indicated in FIG. 5B. Accordingly, the are many other electrical lead-in interconnect schemes which are possible and possibly even preferable within the scope of the present invention.

Figure 5C:
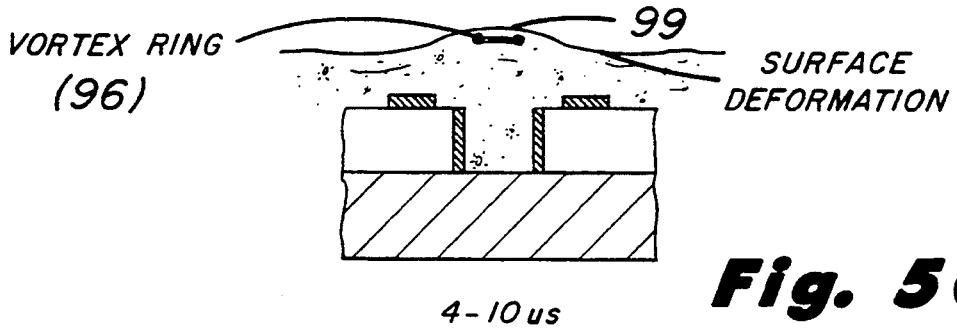

Referring now to FIG. 5B, the vortex ring 96 is produced near the top of the now-constricted cylindrical cavity 88 within the PZT film 84, and once again this vortex ring 96 is produced by the microjet 98 in FIG. 5A which was formed during collapse of the cavity 88. This microjet 98 shears the liquid film 90 as described above with reference to FIGS. 3A through 3H, and once formed, the vortex ring 96 is self-propelled to the film surface 99 as shown in FIG. 5C.

Figure 5D:
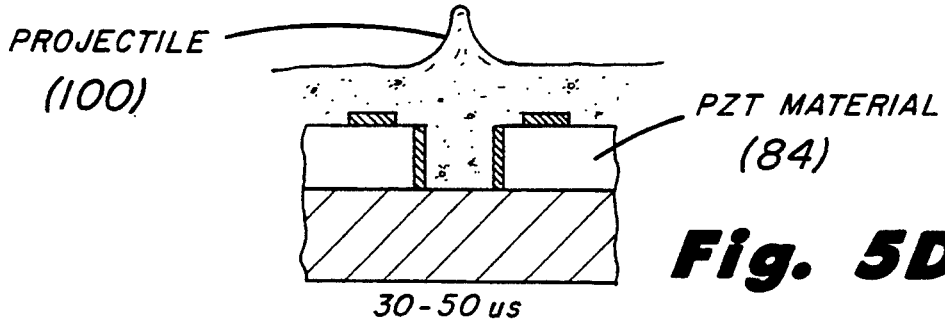
Figure 5E:
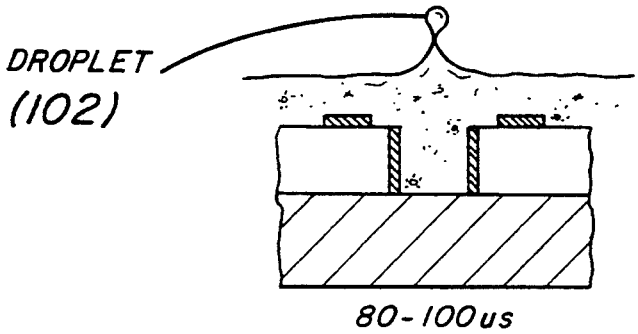

Next, as shown in FIG. 5D, a projectile 100 is formed within the liquid film 90, and this projectile 10 continues its upward movement as viewed in this figure until it produces the droplet break-off profile 102 shown in FIG. 5E. To form vortices 96 of sufficient energy for ink jet printing applications, the collapse velocity of the cavity 88 should be in the range of 5–20 meters per second. The liquid film thickness of the fluid film 90 that covers the PZT layer 84 and fills the cavity 88 should be in the range of 2–50 micrometers, and with a preferred thickness between 5–20 micrometers.

As previously indicated, radial collapse of the PZT cavity 88 may be produced in many different ways and using many different and varied lead-in connections for applying either high voltage pulses or high frequency bursts of energy between appropriate locations on the surface of the PZT layer 84 such that these pulses or bursts will create stresses in the PZT polymer or polycrystalline material to in turn produce the lateral constriction of the cavity as described above with reference to FIGS. 5A through 5E. Therefore, the term "activated" as applied to PZT materials should be interpreted broadly to cover the application of either a single electrical pulse or a high frequency series of pulses to the lead-in interconnects to the PZT cavity. Furthermore, it is to be understood that the present invention covers the use of a chosen plurality of these PZT cavities for a given ink jet printhead application. Thus, in comparison to the conventional prior art thermal ink jet printhead where a polymer barrier layer was first photodefined to produce ink firing chambers and then a metal orifice plate was required to be critically aligned with respect to these firing chambers, this architecture has all been replaced in accordance with the FIGS. 5A through 5E embodiment with a single layer 84 of a selected PZT material having a chosen plurality of cavities 88 photodefined therein.

Figure 3H:
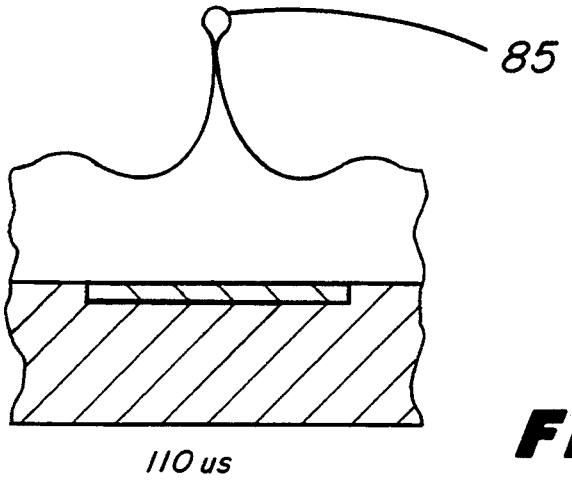

Contrary to the operation of the printhead in the above prior art Xerox patent and using low surface tension, uniformly-nucleating non-aqueous based inks which do not spray, it has been possible to achieve the high degree of directionality and nice clean droplet break-off as is shown in FIG. 3H. Also, the identification of the vortex ring as the critical fluid element for jetting with orificeless ink jet printers has resulted in a means to generate a vortex ring by a vortex activator that is not based on a thermal ink jet device as illustrated in FIGS. 4A through 4C and FIGS. 5A through 5E. These are most significant features of this invention and are directly responsible for opening up a brand new technology within the field of ink jet printing. The jet and droplet profile in FIG. 3H is attributed to uniform nucleating properties of the ink and is directly related to an enhanced print resolution and print quality, and simultaneously the energy transfer efficiencies have been significantly reduced as compared to conventional ink jet orifice plate printing systems.

Various modifications may be made in and to the above described embodiments without departing from the spirit and scope of this invention. For example, the invention is not limited to any particular vortex activator, resistor array, resistor mounting arrangement or electrical interconnection to heater resistors such as those described in the abbreviated schematic drawings referred to above. In addition, there are many other suitable methods which may be used in place of the resistive wire applicators or wiper blades shown in FIG. 1 or the oscillating absorbent cord shown in FIG. 2 for ensuring that a thin controlled uniform film of ink is always present at the surfaces of the vortex activators continuously during a thermal ink jet printing operation.

Furthermore, the present invention is not limited by the particular overall printhead geometries, contours, and protective cover and slot opening configurations and the ink delivery systems therefor. If desired, the ink delivery system 26 shown in FIG. 1 may be incorporated in the body of the heat sink member 12, and these ink delivery systems may include disposable bladder types of ink delivery systems such as those disclosed in U.S. Pat. No. 4,500,895 issued to Roy T. Buck et al, in foam storage ink delivery systems such as those disclosed in U.S. Pat. No. 4,771,295 issued to Jeffrey P. Baker et al, in a balanced capillary type of ink delivery system such as those disclosed in U.S. Pat. No. 4,791,438 issued to Gary E. Hanson et al, or in membrane controlled ink delivery systems of the type described in U.S. Patent application Ser. No. 07/414,893 and application Ser. No. 07/667,710, both by Alfred I. Pan et al, assigned to the present assignee and incorporated herein by reference.

Accordingly, these and many other possible design and constructional modifications are clearly within the scope of the following appended claims.

We claim:

1. An orificeless printhead for an ink jet printer comprising:

a piezoelectric layer disposed on a chosen substrate and having a plurality of cavities therein with defined interior walls for receiving ink therein, and means for deflecting said interior walls of said cavities to produce lateral force vectors on said ink within said cavities for propelling droplets of said ink onto an adjacent print media without passing through an orifice, wherein the lateral force vectors cause a vortex ring to be produced in said ink above at least one of said cavities, and said vortex ring causes an ink droplet to be ejected.

2. The printhead defined in claim 1 wherein said deflecting means includes means for applying electrical signals to said cavities.

3. The printhead defined in claim 1 wherein said piezoelectric layer is selected from the group consisting of piezoelectric polymers and piezoelectric polycrystalline materials.

4. The printhead defined in claim 3 wherein said deflecting means includes means for applying electrical signals to said piezoelectric layer.

5. An orificeless printhead for an ink jet printer comprising:

a piezoelectric layer disposed on a chosen substrate and having a plurality of cavities therein with defined interior walls for receiving ink therein, said piezoelectric layer is selected from the group consisting of piezoelectric polymers and piezoelectric polycrystalline materials, and means for deflecting said interior walls of said cavities to produce lateral force vectors on said ink within said cavities for propelling droplets of said ink onto an adjacent print media without passing through an orifice, wherein said deflecting means including signal applying means for applying electrical signals to said piezoelectric layer and said signal applying means including an inner electrode deposited within said cavities and an outer electrode disposed on an upper surface of said piezoelectric layer.

6. A method of ink jet printing without use of an orifice plate which comprises the steps of:

distributing a film of ink over a piezoelectric layer having a plurality of ink receiving cavities therein with defined interior walls for receiving said ink therein, and deflecting said interior walls of said cavities for generating lateral force vectors on said ink to eject ink droplets onto an adjacent print media, whereby said ejected ink droplets do not pass through an orifice plate, wherein said deflecting produces a vortex ring in said ink above at least one of said cavities, and said vortex ring thereafter causes an ink droplet to be ejected.

7. The method defined in claim 6 wherein said interior walls of said cavities are deflected by applying controlled electrical signals thereto.

8. The method defined in claim 6 which includes applying either a high voltage pulse or a high frequency series of pulses to selected surface locations of said piezoelectric layer and of sufficient energy to create lateral stresses within said piezoelectric layer to in turn produce lateral constriction within said cavities to eject said ink droplets therefrom.

9. A method of ink jet printing without use of an orifice plate which comprises the steps of:

distributing a film of ink over a piezoelectric layer having a plurality of ink receiving cavities therein with defined interior walls for receiving said ink therein, and deflecting said interior walls of said cavities for generating lateral force vectors on said ink to eject ink droplets onto an adjacent print media, said deflecting is produced by applying either a high voltage pulse or a high frequency series of pulses to selected surface locations of said piezoelectric layer and of sufficient energy to create lateral stresses within said piezoelectric layer to in turn produce lateral constriction within said cavities to eject the ink droplets therefrom, wherein the ejection of the ink droplets from said cavities in said piezoelectric layer is produced by first producing a microjet velocity vector within said cavities followed by production of a vortex ring in said ink film above said cavities followed by a projectile in said ink film and finally followed by an ink droplet break-off profile extending from said film of ink, whereby said ejected ink droplets do not pass through an orifice plate.

10. A method of ink jet printing without use of an orifice plate which comprises the steps of:

distributing a film of ink over a piezoelectric layer having a plurality of ink receiving cavities therein with defined interior walls for receiving said ink therein, and deflecting said interior walls of said cavities for generating lateral force vectors on said ink to eject ink droplets onto an adjacent print media, whereby said ejected ink droplets do not pass through an orifice plate, wherein said deflecting causes a vortex ring to be produced in said ink above at least one of said cavities, subsequently causes said vortex ring to be propelled away from said cavity and towards the surface of said ink film, and thereafter said propelled vortex ring causes an ink droplet to be ejected onto an adjacent print media.

11. An orificeless printhead for an ink jet printer comprising:

a piezoelectric layer disposed on a chosen substrate and having a plurality of cavities therein with defined interior walls for receiving ink therein, and means for deflecting said interior walls of said cavities to produce lateral force vectors on said ink within said cavities for propelling droplets of said ink onto an adjacent print media without passing through an orifice, wherein the lateral force vectors produced by said deflecting means cause a vortex ring to be produced in said ink above at least one of said cavities, subsequently cause said vortex ring to be propelled away from said cavity and towards the surface of said ink film, and thereafter said propelled vortex ring causes an ink droplet to be ejected.

* * * * *